US007076200B2

(12) United States Patent
Poletto

(10) Patent No.: US 7,076,200 B2
(45) Date of Patent: Jul. 11, 2006

(54) TANDEM PRINTING APPARATUS WITH A CENTER POSITIONED DUAL FINISHER STATION

(75) Inventor: Anthony G. Poletto, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 126 days.

(21) Appl. No.: 10/975,673

(22) Filed: Oct. 28, 2004

(65) Prior Publication Data

US 2006/0093421 A1 May 4, 2006

(51) Int. Cl.
*B41J 7/32* (2006.01)
*B41J 7/20* (2006.01)
*G03G 16/00* (2006.01)

(52) U.S. Cl. ..... 399/391; 399/388; 399/107

(58) Field of Classification Search ..... 355/23, 355/24; 399/56, 107, 108, 361, 364, 369, 399/377, 391, 388; 400/605; 271/278
See application file for complete search history.

(56) References Cited

U.S. PATENT DOCUMENTS

| | | | | |
|---|---|---|---|---|
| 5,208,640 | A | 5/1993 | Horie et al. | |
| 5,568,246 | A | 10/1996 | Keller et al. | |
| 6,201,946 | B1 | 3/2001 | Takeuchi et al. | |
| 6,925,283 | B1 * | 8/2005 | Mandel et al. | 399/388 |

* cited by examiner

*Primary Examiner*—Andrew H. Hirshfeld
*Assistant Examiner*—Wynn Ha

(57) ABSTRACT

A tandem printing system includes two printers separated by a dual finisher station centered between the two printers. The system's two input/output terminals are controlled to act as one high-speed print engine. With this arrangement, improved productivity is realized if one printer is not functional (i.e., 50% instead of 0%). The centrally positioned dual finisher station simplifies the paper path for the second of the dual finishers.

10 Claims, 2 Drawing Sheets

TANDEM PRINTING APPARATUS WITH A CENTER POSITIONED DUAL FINISHER STATION

BACKGROUND

This disclosure relates in general to copier/printers, and more particularly, to two printers with their outputs linked to a common finisher positioned between them.

Typically, in an effort to meet demand for high end printers, i.e., 100+ pages per minute (ppm), tandem machine designs place the two machines side by side with the result that the output from the first machine to a finisher or output tray for the machines must route around the second machine with complex paper path hardware. In addition, if one of the machines jams or needs supplies, productivity goes down to zero.

Multiple print engines have been used in the past to increase productivity. For example, U.S. Pat. No. 5,208,640 issued May 4, 1993 to Kiyoshi Horie et al. shows an image recording apparatus that includes a plurality of recording modules for substantially simultaneously recording of recording sheets images according to image data supplied thereto, an image data supplier for supplying images to the recording modules, a sheet supplier for supplying the recording sheets to the recording modules, and sheet distributors for distributing the recording sheet thus supplied successively by the sheet supplier to the recording modules. Also, U.S. Pat. No. 6,201,946 B1 issued Mar. 13, 2001 to Masakazu Takeuchi et al. discloses a printing system that includes a main printer that is a black and white printer and a support printer, such as, an inkjet a color printer. The system includes a route setting device for printed sheets.

Obviously, there is still a need for a tandem high end printer system that is not too costly, not too cumbersome with respect to the paper path and does not have to take a 100% hit in productivity when one machine is down.

Accordingly, an improved tandem machine, high end printing system is disclosed that separates the two 65, 75 or 90 ppm machines and places a common finisher between the machines to simplify the paper path. Using these two machines in the simplex mode results in a digital 130, 150 or 180 ppm system. If one of the machines is for some reason out of order, productivity goes to only 50% instead of 100%.

BRIEF DESCRIPTION OF THE DRAWINGS

The foregoing and other features of the disclosure will be apparent and easily understood from a further reading of the specification, claims and by reference to the accompanying drawings in which like reference numerals refer to like elements and wherein:

Figure 1:
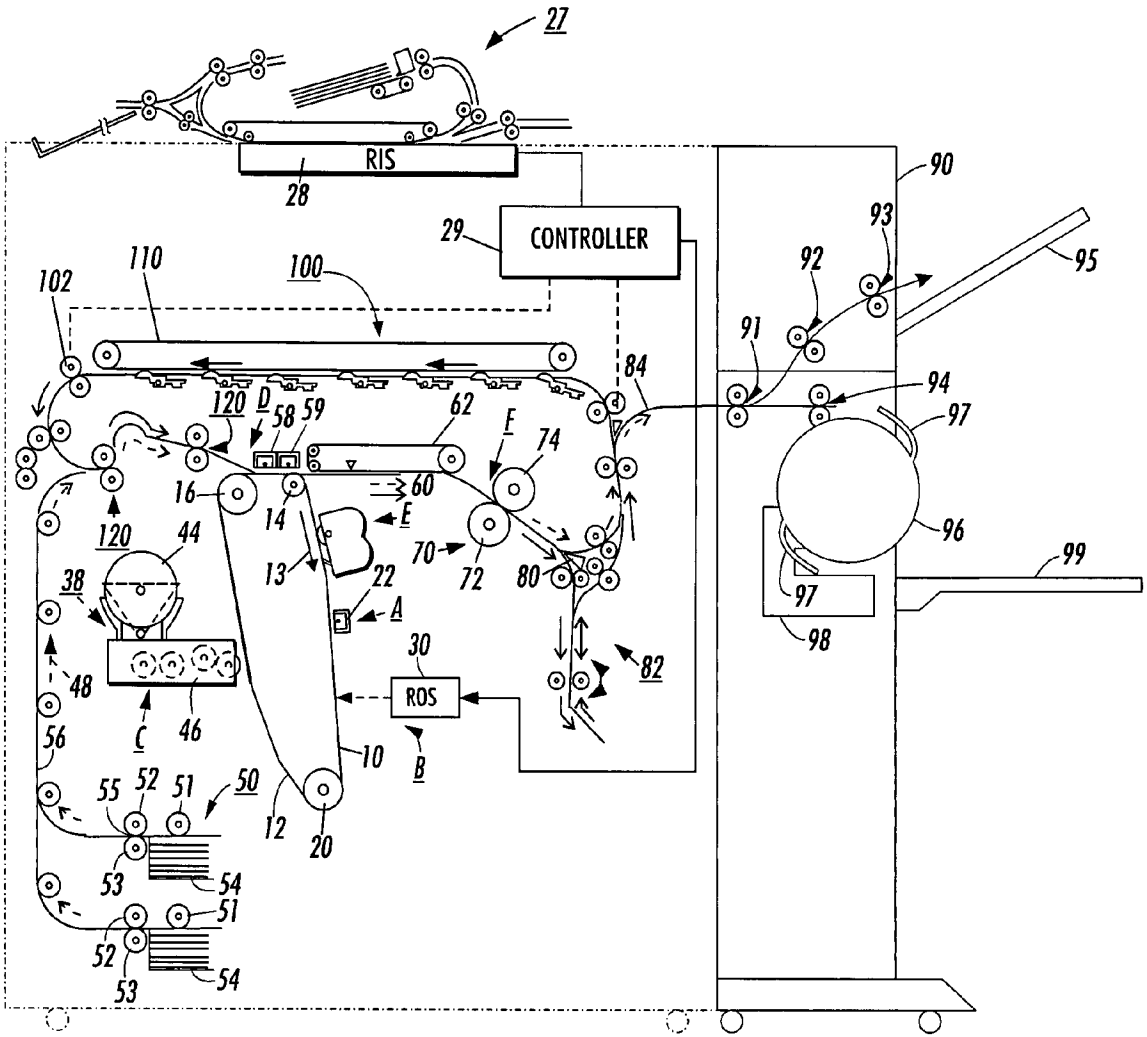
FIG. 1 PRIOR ART
FIG. 1 is a schematic elevation view of a typical prior art 65, 75 or 90 ppm printer.

While the disclosure will be described hereinafter in connection with a preferred embodiment thereof, it will be understood that limiting the disclosure to that embodiment is not intended. On the contrary, it is intended to cover all alternatives, (e.g., 2 copiers, 2 printers, 2 multi-function machines, 1 copier and 1 printer, etc.), modifications and equivalents as may be included within the spirit and scope of the invention as defined by the appended claims.

DETAILED DESCRIPTION

The disclosure will now be described by reference to a preferred embodiment of a tandem printer system that includes a common finisher positioned therebetween.

For a general understanding of the features of the disclosure, reference is made to the drawings. In the drawings, like reference numerals have been used throughout to identify identical elements.

FIG. 1 schematically illustrates a prior art 65, 75 or 90 ppm printer where an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and coverts it to a series of raster scan lines. This information is transmitted to an electronic subsystem (EES) 29 that controls a raster output scanner (ROS) 30 described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At exposure station B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example, the raster output scanner (ROS), indicated generally by reference numeral 30. Preferably, ESS 29 is a self-contained, dedicated minicomputer. The image signals transmitted to ESS 29 may originate from a RIS as described above or from a local and/or remote computer via cable, telephone line or wireless, thereby enabling the electrophotographic printing machine to serve as a remotely located printer for one or more computers. Alternatively, the printer may serve as a dedicated printer for a high speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes arranged to illuminate the charged portions of photoconductive belt 10 on a raster-by-raster basis.

After the electrostatic latent image has been recorded on photoconductive surface 12, belt 10 advances the latent image to a development station C, where toner, in the form of liquid or dry particles or a solid, is electrostatically attracted to the latent image using commonly known techniques. The latent image attracts toner particles from the carrier granules forming a toner powder image thereon. As successively electrostatic latent images are developed, toner particles are depleted from the developer material. A toner particle dispenser, indicated generally by reference numeral 44, dispenses toner particles into developer housing 46 or developer unit 38.

With continued reference to FIG. 1, after the electrostatic latent image is developed, the toner powder image present on belt 10 advances to transfer station D. A print sheet 48 is advanced to the transfer station D by a sheet feeding apparatus 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48 to assist in removing the sheet from the photoreceptor. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output path 84 to finisher 90, or deflects the sheet into the duplex path 100, specifically, first into single sheet inverter 82. That is, if the sheet is either a simplex sheet or a completed duplex sheet having both side one and side two mages formed thereon, the sheet will be conveyed via gate 80 directly via output path 84 to disk finisher 90. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

Sheets forwarded via output path 84 into finisher 90 are conveyed by nips 91, 92 and 93 onto top tray 95, if stapling is not required. And also when locally scanned and stapling not required. If stapling is required, nip 91 conveys the sheets to nip 94, which drives them into fingers 97 of disk 96. Rotation of disk 96 registers the sheets in dual head stapler 98. After stapling, continued rotation of disk 96 deposits the set of sheets onto main tray 99.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive image cycle.

Controller 29 regulates the various machine functions. The controller is preferably a programmable microprocessor, which controls all of the machine functions hereinbefore described. The controller provides a comparison count of the copy sheets, the number of documents being recirculated, the number of copy sheets selected by the operator, time delays, jam correction, etc. The control of all of the exemplary system heretofore described may be accomplished by conventional control switch inputs from the printing machine consoles selected by the operator. Conventional sheet path sensors or switches may be utilized to keep track of the position of the document and the copy sheets.

Figure 2:
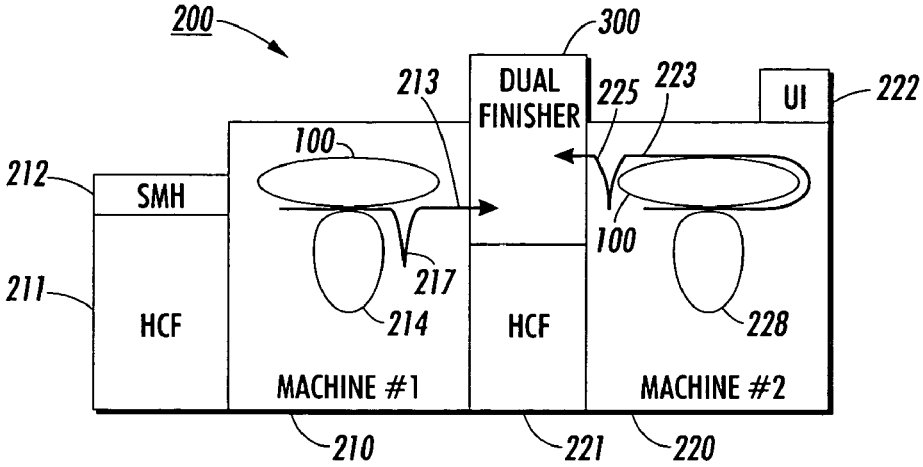
FIG. 2 is a schematic elevation view of a tandem printer system employing two FIG. 1 printers linked by a dual finisher positioned between the printers.
Figure 3:
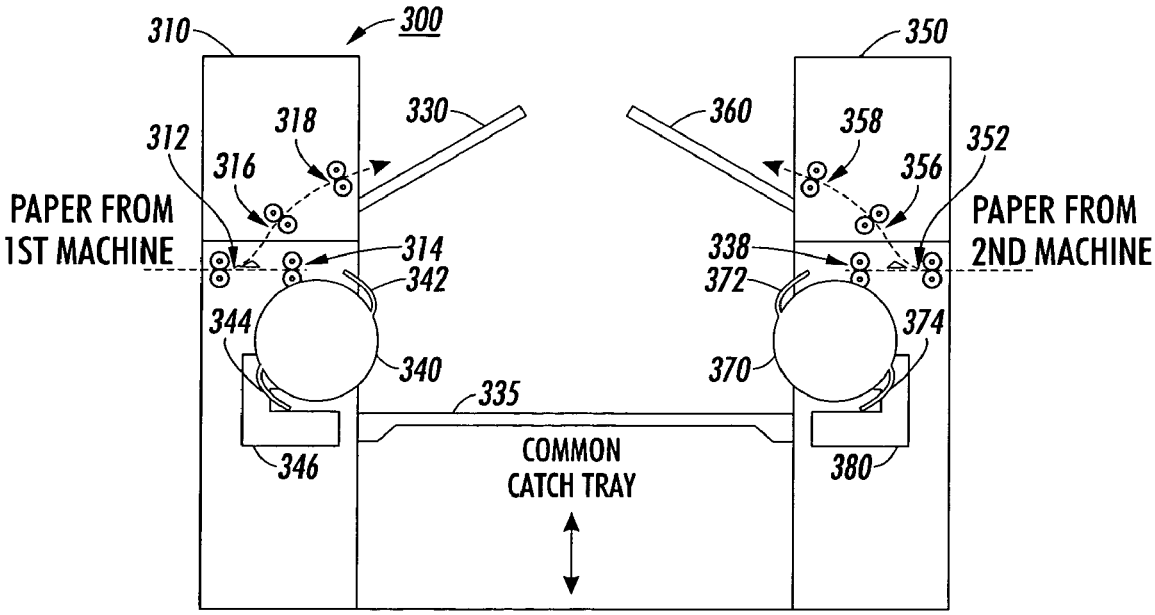
FIG. 3 is a schematic elevation view of the dual finisher of FIG. 2.

Turning next to FIGS. 2 and 3, illustrated schematic views of a tandem printing system are shown that answer the deficiencies of tandem copiers of the past. For example, the tandem printing system in FIG. 2 includes two of the 65, 75 or 90 ppm printers disclosed in FIG. 1 which in a simplex mode results in a high end, digital 130, 150 or 180 ppm machine. User interface (UI) 222 controls the two printers to act as one high-speed print engine. Once the UI is actuated, sheets are fed into the system and machine 1, referred to as reference numeral 210, either from a special materials handler (SMH) 212 or High capacity feeder (HCF) 211. The sheets are conveyed by part of duplex loop 100 in the direction of arrow 213 over photoreceptor 214 to be imaged and later fused. The resultant copies are inverted at 217 (if required) and then deflected away from the duplex loop and outputted into dual finisher station 300. Dual finisher station 300 preferably comprises two conventional finishers that are each sold as part of the Xerox® 4900 shown schematically in FIG. 1. The second machine 220 receives sheets from HCF 221 and conveys the sheets in the direction of arrow 223 past photoreceptor 228 to receive an image with the help of duplex loop 100. Once the now imaged copies are fused, they are conveyed straight through the inverter 225 (no inversion, unless required) and then sent by duplex path 100 towards finisher station 300. Copies from the second machine 220 are now moving right to left in FIG. 2 and are alternated into finisher station 300 with the output from the first machine 210. A diverter (not shown) causes the copy sheets to exit from the left side of machine 220 into finisher station 300. If either of printers 210 or 220 is not operable for some reason, the one working machine maintains productivity at 50% instead of 0% as with prior tandem copier/printer systems. Finisher station 300 is positioned in the center of printers 210 and 220 in order to eliminate the complex hardware needed to go around the second printer and to lessen possible machine down time.

As shown in FIG. 3, finisher station 300 includes first and second finishers 310 and 350, respectively. Sheets conveyed in the direction of arrow 213 from first printer 210 are directed nip 312 which conveys the sheets into first finisher 310 to be stapled as sets or forwarded onto bypass tray 330. Sheets that are not to be stapled are driven by nips 312, 316 and nip 318 onto bypass tray 330. If the sheets are to be stapled as sets, in finisher 310, they are driven by nips 312 and 314 into finger 342 or 344 of disk 340. Disk 340 is rotated in order to register the sheets in dual head stapler 346 where the sheets are stapled into a set. After stapling, disk 340 is rotated in a clockwise direction and allows the set of sheets to drop onto common catch tray 335. Imaged sheets from second printer 220 conveyed in the direction of arrow 223 enter nip 352 and are either conveyed into finisher 350 via nip 338 into either finger 372 or 374 of disk 370 that drives them into dual stapler head 380 to be stapled into sets or transported up and onto bypass tray 360 by the use of drive nips 352, 356 and nip 358. If the sheets are stapled into sets, they are released from fingers 372 or 374 of disk 370 onto common catch tray 335. Common catch tray 335 is a conventional tray with a movable platform that is controlled by springs or rotation of screws, etc. and adapted to reposition itself after a predetermined number of sets have been deposited thereon from finisher 310 and/or finisher 350. Sets from second finisher 350 are ejected alternately with sets ejected from first finisher 310. Second finisher 350 is rotated 180° with respect to standard positioning of first finisher 310, i.e., the inboard side of the finisher is facing outboard. It operates the same as first finisher 310. With second finisher being rotated 180° with respect to the positioning of first finisher 310, stapled sets are alternated from each finisher and sent to common catch tray 335. As the staples now alternate between diagonal corners, stapled sets are half as high as would be the case with both finishers positioned the same. The center positioned, dual finisher station 300 is user friendly since it eliminates bending over for stapled sets as the output in common tray 335 is basically waist high due to its positioning on HFC 221.

It should now be understood that an improvement has been disclosed for a tandem printer system that includes two 65, 75 or 90 ppm machines that feed imaged sheets into a common finisher that is centrally positioned between the machines to simplify the paper path. Using these two machines in the simplex mode results in a digital 130, 150 or 180 ppm system.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A tandem printing system, comprising:

first and second printers, each of said printers having a sheet feeder, a sheet transport, a device for printing images onto sheets supplied from said sheet transport by said sheet feeder, a fuser for fusing said images placed onto the sheets;

a dual finisher station adapted to receive output from each of said first and second printers, said dual finisher station including two finishers center positioned between said first and second printers; and a common catch tray adapted to receive output from both of said two finishers.

2. The tandem printing system of claim 1, wherein imaged sheets from said first printer are inverted before reaching said dual finisher station.

3. The tandem printing system of claim 1, wherein one of said two finishers is rotated 180° with respect to the other.

4. The tandem printing system of claim 1, wherein said second printer includes a loop transport for conveying imaged sheets into one of said two finishers.

5. The tandem printing system of claim 1, wherein stapled sets of imaged sheets are ejected alternately from each of said two finishers into said common catch tray.

6. A tandem electrophotographic printing system, comprising:

first and second electrophotographic printers, each of said printers having a sheet feeder, a sheet transport, a device for printing images onto sheets supplied from said sheet transport by said sheet feeder, a fuser for fusing said images placed onto the sheets;

a dual finisher station adapted to receive output from each of said first and second electrophotographic printers, said dual finisher station including two finishers center positioned between said first and second printers; and at least one catch tray adapted to receive output from said two finishers.

7. The tandem printing system of claim 6, wherein imaged sheets from said first printer are inverted before reaching said dual finisher station.

8. The tandem printing system of claim 6, wherein one of said two finishers is rotated 180° with respect to the other finisher.

9. The tandem printing system of claim 6, wherein said second printer includes a loop transport for conveying imaged sheets into one of said two finishers.

10. The tandem printing system of claim 9, wherein stapled sets of imaged sheets are ejected alternately from each of said two finishers.

* * * * *